United States Patent [19]

Noguchi et al.

[11] 4,043,307

[45] Aug. 23, 1977

[54] FUEL INJECTION SYSTEM FOR AN INTERNAL COMBUSTION ENGINE

[75] Inventors: Masaaki Noguchi, Nagoya; Masaharu Sumiyoshi, Toyota; Taro Tanaka, Chiryu; Hideya Fujisawa, Kariya, all of Japan

[73] Assignees: Nippondenso Co., Ltd., Kariya; Toyota Jidosha Kogyo Kabushiki Kaisha, Toyota, both of Japan

[21] Appl. No.: 549,806

[22] Filed: Feb. 13, 1975

[30] Foreign Application Priority Data

June 24, 1974 Japan ..... 49-72076

[51] Int. Cl.[2] ..... F02M 39/00; F02B 3/00

[52] U.S. Cl. ..... 123/139 AW; 123/139 BC; 123/139 BG; 123/139 AP; 123/32 CY

[58] Field of Search ..... 123/139 AW, 139 BG, 123/139 BC, 139 AP, 139 BE, 32 AC, 32 CY

[56] References Cited

U.S. PATENT DOCUMENTS

| | | | |
|---|---|---|---|
| 1,597,787 | 8/1926 | Hausser | 123/139 BC |
| 2,189,499 | 2/1940 | Trimmer | 123/139 BC |
| 2,483,949 | 10/1949 | Washington | 123/139 BC |
| 2,986,129 | 5/1961 | Henry-Biabaud | 123/32 ST |
| 3,181,520 | 5/1965 | Mock | 123/139 AP |
| 3,608,533 | 9/1971 | Mennesson | 123/32 AC |
| 3,664,318 | 5/1972 | Giuffra | 123/139 AP |
| 3,739,762 | 6/1973 | Jackson | 123/139 AW |
| 3,742,925 | 7/1973 | Gordon | 123/139 AP |

*Primary Examiner*—Carroll B. Dority, Jr.
*Assistant Examiner*—Ronald B. Cox
*Attorney, Agent, or Firm*—Cushman, Darby & Cushman

[57] ABSTRACT

A fuel injection system for an internal combustion engine comprises a fuel metering means operative to meter and adjust the flow of fuel to the engine in accordance with the operating conditions of the engine, fuel injection nozzles disposed in respective intake ports of engine cylinders, a fuel distributor operative to distribute the metered and adjusted flow of fuel to the respective injection nozzles, an advancer responsive to the increase in the speed of the engine operation to advance the fuel distribution timing of the distributor, and a fuel distribution timing varying means responsive to the variation in the load on the engine to vary the fuel distribution timing of the distributor.

7 Claims, 6 Drawing Figures

FUEL INJECTION SYSTEM FOR AN INTERNAL COMBUSTION ENGINE

The present invention relates to a fuel injection system for an internal combustion engine and, more particularly, to a fuel injection system of the class specified wherein the flow of fuel to the engine is metered and adjusted in accordance with the operating conditions of the engine and is distributed to fuel injection nozzles of the engine cylinders by means of a fuel distributor.

In the field of internal combustion engines there has recently been an increasing use of fuel supply systems in which fuel is injected into intake passages for respective engine cylinders in the attempt to purify the exhaust gas. As compared with the conventional fuel supply system in which a carburetor is used, the injection type fuel supply system is known as being more advantageous from the view point of purification of exhaust gas since this type of fuel supply system is capable of supplying an engine with an accurately metered amount of fuel appropriate to meet the requirements of engine operation. Thus, there have been various kinds of fuel injection systems known in the art. However, while each of the known kinds of fuel injection systems is satisfactory with respect to a certain point of view, it is unsatisfactory with respect to another point of view. For example, electronic fuel injection systems, a part of which has been partically used, advantageously provide a wide range of control and are operable to accurately control the fuel supply to engines but are disadvantageous in that the systems are expensive and unsatisfactory from the economical point of view. In addition, all of the known kinds of fuel injection systems fall short of satisfactority achieving the purification of engine exhaust gases.

The present invention aims to eliminate the disadvantages of the prior art and provide an improved fuel injection system for an internal combustion engine which economically and reliably achieves the purification of engine exhaust gas.

The inventors have conducted considerable research on purification of exhaust gases of internal combustion engines which are equipped with injection type fuel supply systems. Through the research, it has been found that not only the accuracy of metering the supply of fuel to an engine but also the manner and timing of the injection of fuel into the engine greatly affect the purification of exhaust gas. It has also been found that the harmful components of exhaust gas can effectively be reduced by injecting a fuel into the engine so that a part of the fuel charge required by the engine is injected during an intake stroke of the engine while the rest of the fuel charge is injected during the succeeding compression stroke of the engine.

On the basis of these discoveries, the present invention provides a fuel injection system including a fuel metering means responsive to the operating conditions of the engine to meter and adjust the flow of fuel supplied to the engine, a fuel injection nozzle disposed in each intake passage for injecting the fuel, a fuel distributor operative to distribute the metered and adjusted flow of fuel to the fuel injection nozzles so that the injection of fuel by each injection nozzle is performed for a period extending from the time before the corresponding intake valve is closed to the time after the intake valve is closed and an advancer operative in response to the increase of the engine speed to advance the fuel distribution timing of the distributor.

The fuel distributor may preferably be designed such that the ratio of the amount of fuel injected in an intake stroke relative to the amount of fuel injected in the succeeding compression stroke is of a predetermined constant value. The distributor may preferably be synchronously driven by the engine in properly timed relationship.

The advancer is advantageously operative to advance the fuel distribution timing of the distributor in accordance with an increase in the engine speed in order to compensate for the dynamic injection timing retardation otherwise caused. The injection timing retardation is due partly to lengthy fuel conduits extending between the distributor and the respective injection nozzles and partly to the peculiar behavior of fuel flow at the time of the opening and closing of the respective fuel injection nozzles. The advancer therefore insures that the above-mentioned predetermined ratio of the amounts of the injected fuel is kept constant.

Preferably, the above-mentioned ratio of the fuel amounts may be varied in accordance with the variation in the load on the engine to further improve the purification of exhaust gas. For this purpose, the fuel distribution timing of the distributor may also be controlled by an additional means which is operative to vary the fuel distribution timing of the distributor. The additional means may preferably be operatively connected to a throttle value in an air intake pipe of the engine so that the opening and closing movement of the throttle valve is transmitted to the distributor.

The present invention will be described by way of example with reference to the accompanying drawings.

Figure 1:
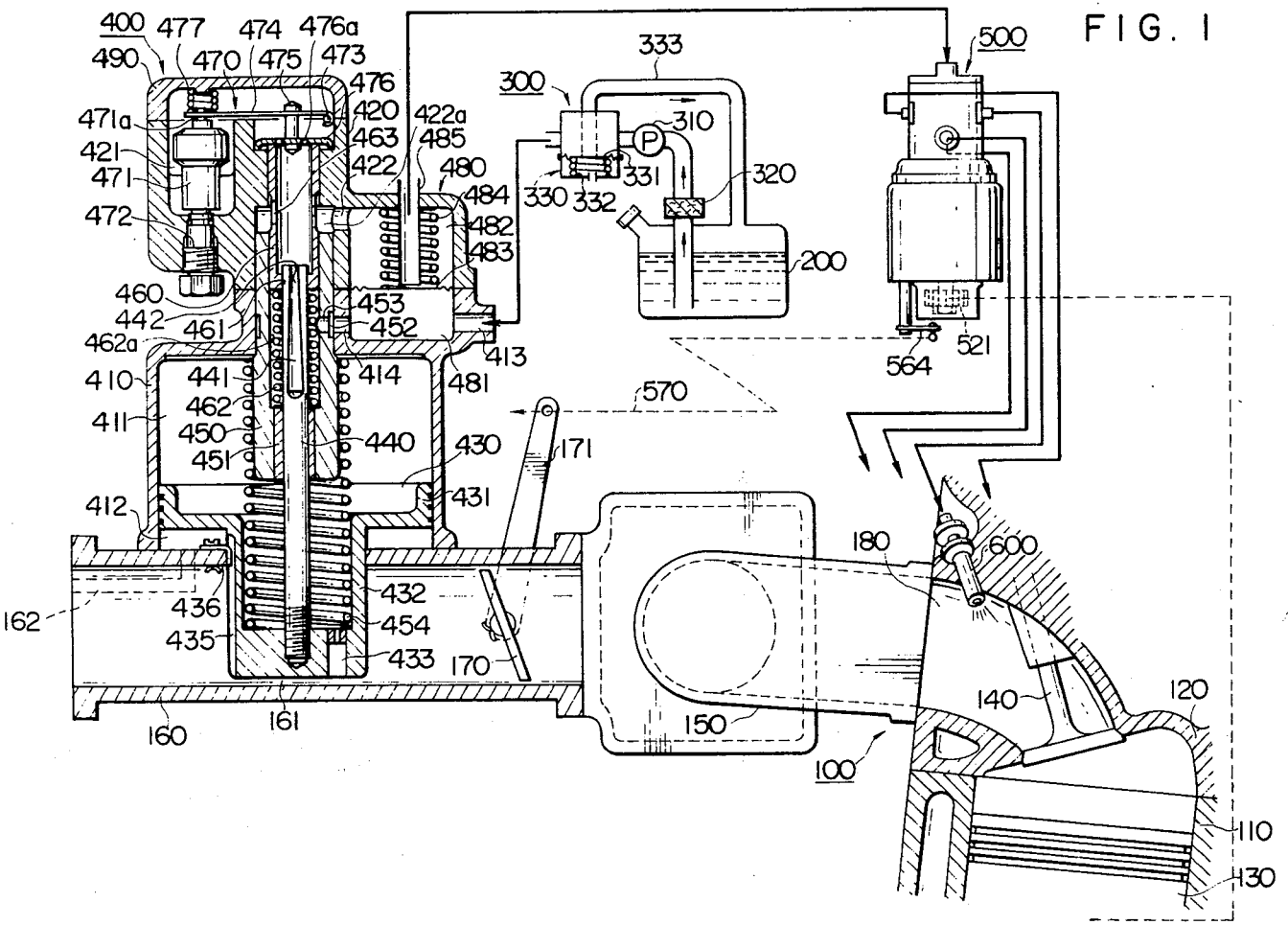
FIG. 1 is a partially sectional diagrammatic view of an embodiment of the fuel injection system according to the present invention.

Referring to FIG. 1, the preferred embodiment of the fuel injection system according to the invention is designed for use with a 4-cylinder internal combustion engine generally designated by 100 and having cylinders 110, a cylinder head 120, pistons 130, intake valves 140, an intake manifold 150, an intake pipe 160 and a throttle valve 170. While only one cylinder 110 is shown, four such cylinders are formed in the cylinder block of the engine and corresponding four intake ports 180 are formed in the cylinder head 120. The engine has four such intake valves 140 each disposed in one of the intake ports 180 to open and close the same. The intake manifold 150 is to interconnect the intake pipe 160 and the intake ports 180. For this purpose, the manifold 150 is divided into four branches correspondingto the respective intake ports 180. The throttle valve 170 is disposed in the intake pipe 160 to control the air flow through the intake pipe depending upon the degree of opening of the valve. The throttle valve is connected with a lever 171 which is adapted to be actuated by an accelerator pedal (not shown) so as to control the opening of the throttle valve.

The fuel injection system of the present invention comprises a fuel supplying means 300 for feeding fuel (i.e., gasoline) from a fuel tank 200 at a constant pressure, fuel metering means 400 operable in response to the operating conditions of the engine 100 to meter and adjust the fuel fed by the fuel supplying means 300, a distributor 500 operative to distribute the fuel from the metering means 400, and injection nozzles 600 operative to inject the distributed fuel into the engine 100. The fuel metering means 400 is provided on the intake pipe 160 upstream of the throttle valve 170. The fuel injection nozzles 600 are disposed in the intake ports 180 upstream of the intake valves 140, respectively (i.e., there are a total of four such fuel injection nozzles 600 in total).

The above-mentioned respective means will be described in detail hereunder. The fuel supplying means 300 includes a fuel pump 310 operative to pump up the fuel from the fuel tank 200 through a fuel filter 320 into a pressure regulator 330 which comprises a diaphragm 331, a spring 332 and an overflow pipe 333 and is operative to adjust the pressure of the fuel at a controlled, constant pressure which, for example, may preferably be 3 to 4 kg/cm$^2$.

The fuel metering means 400 includes lower and upper bodies 410 and 420 secured together by appropriate conventional means not shown. The lower body 410 has its bottom end secured to the intake pipe 160 of the engine 100 and the top end connected to the upper body 420. A suction piston 430 has an upper part 431 axially slidably engaging a cylinder provided in the lower body 410. The piston 430 also has a lower part 432 having a diameter smaller than that of the upper part 431 and slidably extending into the intake pipe 160 transversely of the axis thereof. The piston 430 cooperates with the lower body 410 to define an upper vacuum chamber 411, while a lower, atmospheric pressure chamber 412 is defined by the lower body 410, the suction piston 430 and the outer wall of the intake pipe 160. The bottom end face of the lower part 432 of the piston 430 cooperates with the inner peripheral surface of the intake pipe 160 to define a venturi 161. It will be appreciated that the cross-sectional area of the venturi is variable with the extent of the projection of the suction piston 430 into the intake pipe 160.

In the bottom wall of the lower part 432 of the suction piston 430, a restricted vacuum inlet 433 is formed and located at the downstream end of the venturi 161 to communicate the vacuum and chamber 411 with the venturi 161 so that the vacuum at the venturi is introduced into the vacuum chamber 411. On the other hand, the intake pipe 160 of the engine 100 is provided with an atmospheric pressure intake passage 162 which communicates the atmospheric pressure chamber 412 with the atmosphere so that the atmospheric pressure is introduced into the chamber 412.

A compression coil spring 454 extends between the suction piston 430 and the lower body 410 to bias the piston downwardly. In the outer peripheral surface of the lower part 432 of the suction piston 430 is formed an axial groove 435 with which a member 436 fixed to the suction pipe 160 slidably engages to prevent rotation of the piston 430 relative to the pipe 160.

A metering rod 440 has its bottom end portion secured to the suction piston 430 for axial movement therewith. The intermediate portion of the rod 440 slidably extends through a bushing 451 which is fitted into a tubular guide sleeve 450 which extends through and is fixed to the top and bottom portions of the lower and upper bodies 410 and 420. The upper end portion of the metering rod 440 axially slidably extends into a tubular metering member 460 through a metering opening 461 formed in the bottom end wall thereof. A downwardly diverging metering groove 441 is formed in the peripheral outer surface of the metering rod 440 and extends axially downwardly a distance from the upper end of the rod. The metering groove 441 cooperates with the metering opening 461 in the metering member 460 to define a metering orifice 442. The cross-sectional area of the orifice 442 is variable by the axial movement of the metering rod 440 relative to the metering member 460. The latter is axially slidably received partly in the guide sleeve 450 and partly in the upper body 420 and upwardly biased by a compression coil spring 462 extending between the bottom end of the metering member 460 and the guide sleeve 450, while the metering member 460 is downwardly biased by a spring 477 used in a temperature compensation means 470 to be described later. It will be appreciated that the axial movement of the metering member 460 relative to the guide sleeve 450 also acts to vary the area of the metering orifice 442.

The temperature compensation means 470 is housed in a chamber 421 defined by the upper body 420 and a cover 490 which is secured thereto. The compensation means includes a temperature sensor 471 which is disposed in the chamber 421 and which utilizes a wax to detect the temperature in the chamber 421 to thereby axially move a rod **471*a* which secured to the sensor as the temperature varies. An adjust screw or bolt 472 extends through a wall of the upper body 420 to the sensor 471 for adjusting the position of the sensor relative to the body 420. A lever 474 is pivotally mounted on a pin 473 and is pivotally movable up and down by the axial movement of the rod 471*a*. A disc member or washer 476 having a plurality of apertures 476*a* formed therein is disposed in contact with the top end of the tubular metering member 460 and secured to the lever 474 by means of a pin 475 so that the washer 476 is movable with the lever 474. The above-mentioned spring 477 is disposed between the cover 490 and the lever 476 to bias the same downwardly against the upward movement of the rod 471*a* so that the washer 476 is urged against the metering member 460 to move the same downwardly. The temperature compensation means 470 is operative such that, when the temperature sensor 471 detects an elevated temperature, the sensor pivotally moves the lever 474 and thus the washer 476 upwardly against the force of the spring 477 to allow the tubular metering member 460 to be upwardly moved by the spring 462 relative to the metering rod 440 with the resultant decrease in the area of the metering orifice 442. The springs 462 and 477 are so chosen that the spring 477 applies a greater force to the metering member 460 than the force applied by the other spring 462**.

On the side of the tubular metering member 460 opposite the temperature sensor 471, the upper body 420 of the fuel metering means 400 is provided therein with a differential pressure regulator 480 which includes a diaphragm 483 which cooperates with the lower and upper bodies 410 and 420 to define a first lower chamber 481 and a second upper chamber 482. The diaphragm 483 is biased toward the first chamber 481 by a compression coil spring 484 disposed in the second chamber 482. An outlet pipe 485 extends from the second chamber 482 and has its inner open end disposed adjacent to the diaphragm 483. The first chamber 481 is communicated with the pressure regulator 330 through a passage 413 formed in the lower body 410, while the chamber 481 is in communication with the metering orifice 442 through a passage 414 formed in the lower body 410, an annular groove 452 formed in the outer peripheral surface of the guide sleeve 450, a radial passage 453 formed in the guide sleeve 450, an annular space **462*a* defined between the guide sleeve 450 and the metering rod 440 and the groove 441 in the outer periphery thereof. The second chamber 482 is communicated with the metering orifice 442 through a passage 422 formed in the upper body 420, an annular space 422*a* defined between the upper body 420, the top end of the guide sleeve 450 and the metering member 460, a radial passage 463 formed in the metering member 460 and the inner space defined in the metering member 460, while the second chamber 482 is in communication with the fuel distributor 500 through the outlet pipe 485. The differential pressure regulator 480 is operative to regulate the pressure difference between the first and the second chambers 481 and 482 and, thus, across the metering orifice 442 so that the pressure difference is of a substantially constant value as determined by the force of the spring 484. The cover 490 is fixed to the upper body 420.**

With the above arrangement, the fuel metering means 400 is operative to receive a fuel from the fuel supplying means 300 through the passage 413 and meter and adjust the fuel by the function of the metering orifice 442 which is variable with the operating conditions of the engine 100 and, particularly, the variation in the flow of air into the engine. The metered and adjusted fuel flows out of the metering means 400 through the outlet pipe 485 to the distribution means 500.

The operation of the metering means 400 will be described in more detail. An air flow through the venturi 161 produces therein a vacuum which is introduced into the vacuum chamber 411. As the atmospheric chamber 412 is in communication with the atmosphere, the suction piston 430 is moved upwardly against the compression spring 454 in accordance with the magnitude of the vacuum introduced into the vacuum chamber 411. The movement of the piston 430 varies the cross-sectional area of the venturi 161 so that the velocity of the air flowing through the venturi is kept constant with a result that the position or level of the suction piston 430 is in proportion to the air flow through the intake pipe 160. The position of the metering rod 440 relative to the metering member 460 and, thus, the cross-sectional area of the metering orifice 442 depends upon the level of the suction piston 430. Since the pressure difference across the metering orifice 442 is kept constant by means of the differential pressure regulator 480, as discussed above, the fuel flowing to the metering orifice 442 from the fuel supplying means 300 through the passage 413, the first chamber 481, the passage 414, the annular groove 452, the radial passage 453 and the annular space **462*a* is continuously metered and adjusted by the metering orifice 442 and continuously flows through the interior of the metering member 460, the passage 463, the annular space 442*a* and the passage 442 into the second chamber 482 from which the fuel flows through the outlet pipe 485 toward the distributor 500. Thus, it will be appreciated that the fuel is metered and adjusted in accordance with the amount of air sucked into the engine 100.**

The temperature compensation means 470 is operative in response to the temperature of the fuel because the chamber 421 is filled with an amount of fuel introduced into the chamber from the interior of the metering member 460 through the apertures **476*a* in the washer 476. When the temperature of the fuel is relatively low, the temperature compensation means 470 moves the metering member 460 downwardly relative to the metering rod 440 to increase the fuel passage area of the metering orifice 442. When the temperature of the fuel is elevated, the temperature compensation means 470 operates to allow the metering member 460 to be moved upwardly by the spring 462 to thereby reduce the area of the metering orifice 442.**

Figure 2:
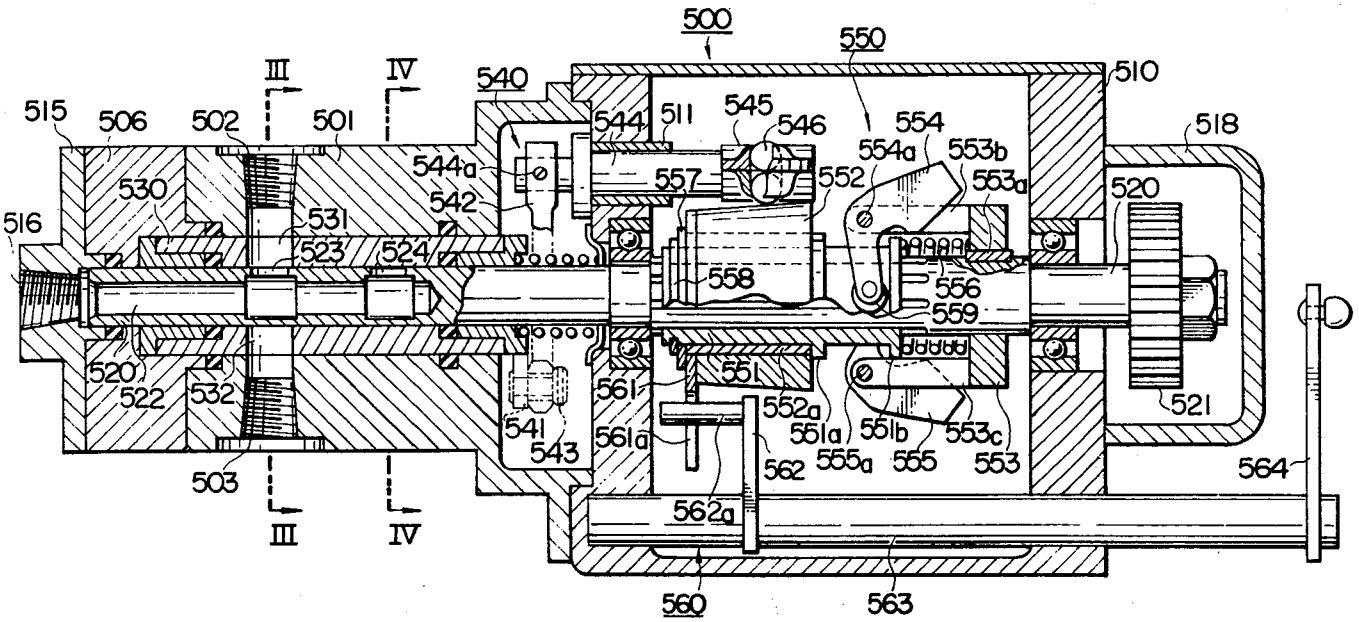
FIG. 2 is an axial sectional side view of a fuel distributor shown in FIG. 1.
Figure 3:
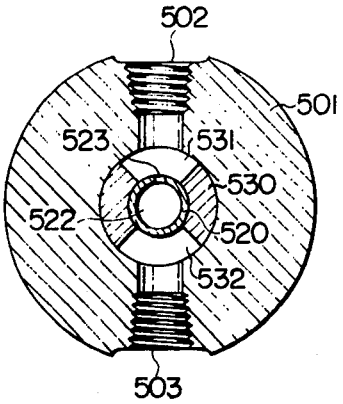
FIGS. 3 and 4 are sectional views of parts of the fuel distributor taken along lines III — III and IV — IV in FIG. 2, respectively.
Figure 4:
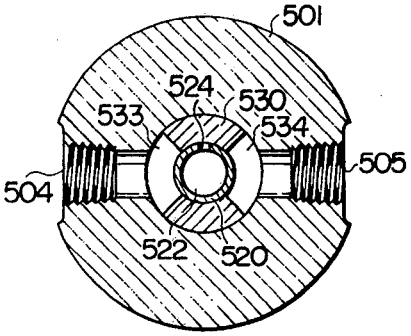

The fuel distributor 500 will be described will reference to FIGS. 2 to 5. Referring first to FIGS. 2 to 4, the fuel distributor 500 comprises a first block 501, a second block 506, a housing 510, an end plate 515 and a cover 518 secured together to form the body of the distributor. A distributor shaft 520 rotatably extends through the first and second blocks 501 and 506 and the housing 510 and has its one end projecting into a space defined by the cover 518 which end is secured with a gear 521. The shaft 520 is adapted to be driven by the engine 100 through a transmission means (not shown) which drivingly interconnects the gear 521 and the engine. The arrangement is such that the shaft 520 is driven in synchronism with the engine operation and rotated a single revolution while the crankshaft (not shown) of the engine is rotated two revolutions. The end plate 515 is formed therein with a fuel inlet 516 in communication with which an axial fuel passage 522 is formed in the other or left end portion of the shaft 520. A pair of axially spaced radial fuel distribution slits 523 and 524 are formed in the periphery of the shaft 520 to communicate the axal passage 522 with the exterior of the shaft. The slits 523 and 524 are axially aligned, as will be seen in FIG. 2. The shaft 520 is snugly received in and rotatably extends through a control cylinder 530 which in turn extends rotatably into the second block 506 and through the first block 501. The control cylinder 530 is provided with two pairs of fuel passages 531 and 532 and 533 and 534 as shown FIGS. 3 and 4. As will be seen in FIGS. 2 and 3, one of the fuel passage pairs (531 and 532) is arranged in the same axial position with respect to the axis of the shaft 520 as the slts 523, while the other fuel passage pair (533 and 534) is positioned in the same axial position with respect to the axis of the shaft 520 as the other slit 524 as shown in FIG. 4. As best shown in FIGS. 3 and 4, th fuel passages 531 and 552 are diametrically opposite each other while the fuel passages 533 and 534 are also diametrically opposite one another. In addition, the two pairs of the fuel passages 531 to 534 are arranged such that these passages are angularly spaced 90 degrees one from another. The fuel passages 531 to 534 each extend 90° circumferentially of the control cylinder 530 and are in communication with fuel outlets 502, 503, 504 and 505 formed in the first block 501, respectively.

As the shaft 520 is rotated, the axial fuel passage 522 in the shaft is successively brought into communication with the fuel passage 531 to 534 formed in the control cylinder 530; i.e., the fuel passage 522 is communicated first with the fuel passage 531 through the distribution slit 523 (as shown in FIGS. 2 and 3), then with the fuel passage 533 through the distribution slit 524, then with the fuel passage 532 through the distribution slit 523 and lastly with the fuel passage 534 through the distribution slit 524. Since each of the fuel passages 531 to 534 extends 90 degress in the circumferential direction of the control cylinder 530, there never occurs a situation in which the axial fuel passage 522 is not in communication with any of the fuel passages 531 to 534 and, in fact, it is assured that the passage area in communication with the fuel passage 522 is always kept constant.

Figure 5:
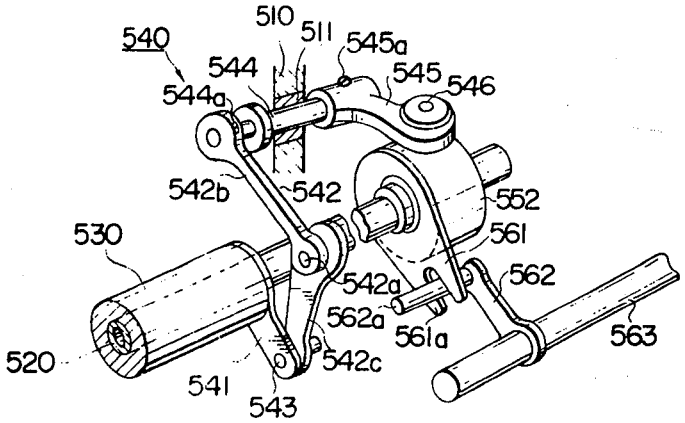
FIG. 5 is a perspective view of a fuel distribution timing controlling means shown in FIG. 2.

The time when the fuel passage 522 is brought into communication with the respective fuel passages 531 to 534 (this time will be hereunder termed "distribution timing") can be varied by rotating the control cylinder 530 relative to the first block 501. For this purpose, the fuel distributor 500 is provided with a fuel distribution timing controlling means 540 disposed in the housing 510. As best seen in FIG. 5, the distribution timing controlling means includes an arm 541 secured at one end to the control cylinder 530. The other end of the arm 541 is pivotally connected by a pin 543 to one end of an intermediate link 542 consisting of a pair of levers 542*b* and 542*c* which are pivotally connected by means of a pin 542*a.* The other end of the intermediate link 542 is secured by a set screw 544*a* to one end of a shaft 544 rotatably extending through a bushing 511 supported by the housing 510. The other end of the shaft 544 is secured by a set screw 545*a* to one end of a cam follower lever 545 which is provided with a cam follower 546 at the other end. In the illustrated embodiment of the invention, the cam follower 546 comprises a pair of balls housed in the other end of the cam follower lever 545, as best shown in FIG. 2. The other end of the cam follower lever 545, i.e., the cam follower 546, is adapted to be moved up and down to rotate the shaft 544. The rotation is transmitted by the intermediate link 542 to the arm 541 so that the control cylinder 530 is rotated relative to the first block 501. The setting of the shaft 544 with respect to the lever 545 and the link 542 is adjustable by means of the set screws 544*a* and 545*a.*

Referring again to FIG. 2, the fuel distribution means 500 is also provided with a fuel distribution timing advancer 550 disposed in the housing 510 and including a sleeve 551 having its inner peripheral surface engaged with the outer peripheral surface of the shaft 520 by means of splines so that the sleeve is rotatable with the shaft and slidable with respect to the shaft. A cam member 552 having a three-dimensional outer cam surface is mounted on the outer periphery of the sleeve 551 adjacent to the cam follower 546 with a busing 552*a* interposed between the cam member and the sleeve. A weight holder 553 is secured to the shaft 520 by means of a key 553*a.* The weight holder 553 has a pair of diametrically opposite arms 553*b* and 553*c* connected thereto at their one ends. Two weights 554 and 555 are pivotally mounted on the other end portions of the arms 553*b* and 553*c* by means of pins 554*a* and 555*a,* respectively. A compression coil spring 556 extends around the shaft 520 and between the right end face (as viewed in FIG. 2) of the sleeve 551 and the weight holder 553 and always biases the sleeve leftward, i.e., in a direction away from the weight holder. The sleeve 551 is formed on the outer peripheral surface with annular flanges 551*a* and 551b at the intermediate and right end portions thereof, respectively. The cam member 552 is mounted on the sleeve 551 between the left end thereof and the intermediate flange 551*a* and axially supported in this position by the flange 551*a* and a stop 557 and a circular clip 558 both provided at the left end of the sleeve 551. The cam member 552 is movable axially with the sleeve 551 but rotatable independently of the sleeve. The weights 554 and 555 are of generally arcuate shape and have their one ends mounted with rolls 559 (only the roll on the weight 554 is shown) which are adapted to be in rolling contact with the right flange 551*b* on the sleeve 551. The cam follower 546 of the fuel distribution timing controlling means 540 is in sliding contact with the three-dimensional cam surface of the cam member 552. The fuel distribution timing advancer 550 is operative such that, when the shaft 520 is rotated together with the sleeve 551, the weight holder 553 and the weights 554 and 555, the centrifugal force acting on the weights causes the radially outer parts of the weights to expand radially outwardly away from the holder 553 so that the rolls 559 are urged against the flange 551*b* to bias the sleeve 551 and the cam member 552 rightward against the compression spring 556 with a result that the position of the cam follower 546 with respect to the cam member 552 is varied to rotate the control cylinder 530 relative to the first block 501. The cam member 552 is not rotated by the rotation of the shaft 520.

The fuel distributor 500 is further provided with a fuel distribution timing varying means 560 which comprises an arm 561 secured at one end to the left end of the cam member 552 and formed with a narrow notch 561*a* in the other end, a lever 562 having mounted on one end a pin 562*a* engaged with the notch 561*a* in the arm 561, a shaft 563 which is rotatably supported by the housing 510 and to which the other end of the lever 562 is secured, and a lever 564 secured to one end of the shaft 563 which extends outwardly from the housing 510. The lever 564 is mechanically connected to the throttle lever 171 by means of a wire 570, as shown in FIG. 1. The fuel distribution timing varying means 560 is operative such that, when the throttle valve 170 of the engine 100 is rotated, the rotation is transmitted through the lever 171, the wire 570 and the lever 564 to the shaft 563 so that it is rotated together with the lever 562 and the pin 562*a* with a result that the arm 561 is rotated with the cam member 552 due to the engagement of the pin 562*a* with the arm 561. The rotation of the cam member 552 varies the position of the cam follower 546 of the distribution timing controlling means 540 so that the control cylinder 530 is rotated relative to the first block. For this purpose, the cam member 552 has on its outer peripheral surface a circumferentially gradually raised part, though not shown.

The fuel inlet 516 in the end plate 515 of the distributor 500 is connected with the fuel outlet pipe 485 of the metering means 400, while the fuel passages 531 to 534 in the control cylinder 530 are communicated with fuel outlets 502, 503, 504 and 505 formed in the first block 501, respectively. The fuel outlets 502 to 505 are coupled to the respective fuel injection nozzles 600 by means of conduits, as diagrammatically illustrated in FIG. 1. The continuous flow of fuel metered by the metering means 400 is received through the fuel inlet 516 into the fuel passage 522 in the shaft 520. Due to the rotation of the shaft 520, the fuel is successively distributed through the distribution slits 523 and 524 to the fuel passage 531 to 534 in the control cylinder 530. The distributed flows of the fuel are fed through the fuel outlets 502 to 505 to the injection nozzles 600, respectively. Since the shaft 520 is driven in synchronized relationship with the rotation of the engine 100 so that the shaft is rotated a revolution per two revolutions of the engine, the distributor 500 is operative to supply the respective injection nozzles 600 with fuel one time for each nozzle per each cycle of the engine operation. The fuel supply to each nozzle is intermittent. The nozzles 600 inject the supplied fuel into the respective intake ports 180 of the respective cylinders 110.

The fuel distribution timing at which the distributor 500 distributes the fuel to the respective nozzles 600, i.e., the rotational relationship between the shaft 520 and the crankshaft of the engine 100 is set such that the injection of fuel by each injection nozzle 600 is performed for period extending from the time before the corresponding intake valve 140 is closed to the time after the valve is closed with a result that the fuel is injected into each cylinder for the interval extending from an intake stroke of the cylinder to the succeeding compression stroke in one cycle of the engine 100. Moreover, the ratio of the amount of fuel injected in the intake stroke relative to the amount of fuel injected in the compression stroke is of a predetermined constant value. The predetermined ratio is variable in accordance with the degree of the opening of the throttle valve 170, i.e., the load on the engine. Specifically, the fuel distribution timing varying means 560 of the distributor 500 and the distribution timing controlling means 540 thereof cooperate to rotate the control cylinder 530 relative to the first block 501 thereby to vary the predetermined ratio.

Preferably, the variation in the ratio of injected amounts of fuel in accordance with the opening of the throttle valve 170 is determined such that the ratio of the amount of fuel injected in an intake stroke relative to the amount of fuel injected in the succeeding compression stroke is 4 : 6 when the opening of the throttle valve 170 is small (during idle and deceleration operations) and, as the opening of the throttle valve 170 is increased, the ratio is gradually increased and is 7 : 3 in normal or acceleration operation.

In addition, the fuel distribution timing is advanced in accordance with the increase in the rotation of the engine in order to compensate for the dynamic injection timing retardation otherwise caused due partly to lengthy conduits extending between the respective fuel outlets 502 to 505 in the distributor 500 and the respective fuel injection nozzles 600 and partly to peculiar fuel flow behavior at the time of the opening and closing of the respective fuel injection nozzles 600 for thereby insuring that the ratio of the amounts of injected fuel before and after each intake valve closure is kept constant regardless of the variation in the engine rotation. The advancement is performed by the fuel injection timing advancer 550 and the distribution timing controlling means 540 which cooperate to rotate the control cylinder 530.

Figure 6:
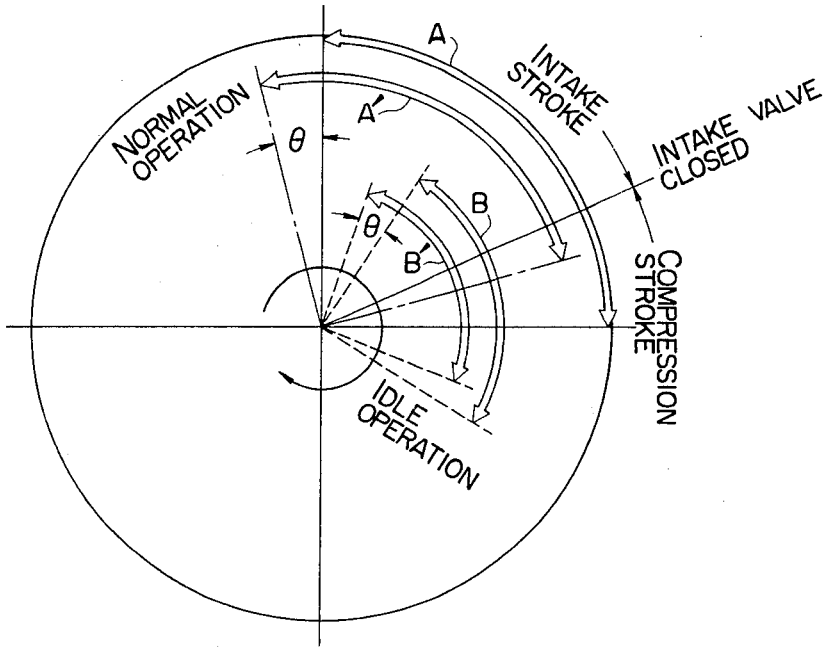
FIG. 6 is a graphic illustration of the fuel distribution timing according to the fuel distributor.

Thus, the fuel injection timing for each engine cylinder is controlled as graphically illustrated in FIG. 6 in which one half the degrees of rotation of the engine crankshaft (the degree of rotation of the shaft 520 of the distributor 500) are indicated in clockwise direction. The letter A in the figure designates the fuel distribution timing in the normal or acceleration operation of the engine 100 at a low speed. In this operating condition, when the speed is increased to a high speed, the distribution timing (shown by the letter A') is advanced $\theta°$ which are made consistent with the degrees of the dynamic injection timing retardation discussed above, with a result that the fuel injection timing of each injection nozzle is kept constat regardless of the engine speed. The letter B in the figure designates the fuel distribution timing in the idle or deceleration operation at a low speed. In a deceleration operation at a high speed, the distribution timing will be as shown by the letter B'. In this case, however, the fuel injection timing of each nozzle is retarded due to the dynamic fuel injection timing retardation and will be the same as in the case of the fuel distribution timing B.

The fuel injection nozzles 600 may be conventional ones.

In the fuel distributor 500 in the illustrated embodiment of the invention, the fuel distribution timing varying means 560 is employed to vary the fuel distribution timing in accordance with the opening of the throttle valve 170 of the engine 100. The distribution timing varying means, however, is not the essential element for the present invention because this means may be omitted in the case where the exhaust gas can be purified without the use of the means. When the distribution timing varying means is not used in the system of the present invention, the fuel is injected into the engine 100 at a constant timing regardless of the throttle opening.

Even in the case where the distribution timing varying means is employed, the distribution timing does not always have to vary continuously in accordance with the variation in the throttle valve opening but, instead, may be varied in two steps, one for a certain range of the throttle valve opening and the other for the remainder of the throttle valve opening range.

What is claimed is:

1. A fuel injection system for an internal combustion engine having a plurality of cylinders, an intake pipe, intake ports interconnecting said intake pipe and said cylinders, and intake valves disposed in said intake ports, said system comprising:

fuel metering means mounted on said intake pipe and operating in response to the operating conditions of said enging to meter the flow of fuel supplied to said engine, said fuel metering means including:

a suction piston mounted on said intake pipe and being axially movable in response to the variation in the flow of air passing through said intake pipe;

a first metering member connected to said suction piston for movement therewith;

a second metering member operatively associated with said first metering member to define therewith a fuel metering orifice;

a differential pressure regulator for maintaining constant the difference of the fuel pressure across said fuel metering orifice; and a temperature compensation means engaged with said second metering member and operative in response to the variation of the temperature of the fuel to move said second metering member relative to said first metering member for controlling said fuel metering orifice;

a plurality of fuel injection nozzles each disposed in one of said intake ports for injecting the metered fuel into said intake port;

a fuel distributor means connected to said fuel metering means and said nozzles for distributing the metered fuel to each of said fuel injection nozzles so that the fuel is injected from each of said nozzles into an associated intake port for a period of time extending from the time before an associated intake valve is closed to the time after the same intake valve is closed; and an advancer connected to said distributor means and operative in response to the increase in the rotational speed of said engine to advance the fuel distribution timing of said distributor.

2. A fuel injection system as defined in claim 1, in which said fuel distributor includes:

a control cylinder formed in the periphery thereof with a plurality of fuel passages equal in number to the engine cylinders;

a shaft rotatably extending through said control cylinder and being adapted to be rotated in timed relationship with the rotation of said engine;

said shaft being formed therein with an axial fuel passage connected to said metering means;

said shaft being further formed with at least one fuel distribution slit adapted to be successively brought into communication with respective fuel passages in said control cylinder by the rotation of said shaft relative to said cylinder; and a fuel distribution timing controlling means operatively connected to said advancer for rotating said control cylinder.

3. A fuel injection system as defined in claim 2, in which said advancer includes:

weights mounted on said shaft so that said weights are rotated with said shaft and are expanded radially outwardly of said shaft by centrifugal force; and a cam member operatively associated with said weights so that said cam member is moved relative to said distribution timing controlling means when said weights are expanded;

said cam member having a cam surface operatively associated with said distribution timing controlling means.

4. A fuel injection system as defined in claim 3, in which said distribution timing controlling means includes:

a cam follower means in contact with said cam surface, and a link means inerconnecting said cam follower means and said control cylinder so that the movement of said cam follower means relative to said cam member rotates said control cylinder relative to said shaft.

5. A fuel injection system for an internal combustion engine having a plurality of cylinders, an intake pipe, intake ports interconnecting said intake pipe and said cylinders, and intake valves disposed in said intake ports, said system comprising:

fuel metering means mounted on said intake pipe and operative in response to the operating conditions of said engine to meter the flow of fuel supplied to said engine;

a plurality of fuel injection nozzles each disposed in one of said intake ports for injecting the metered fuel into said intake port;

a fuel distributor means connected to said fuel metering means and said nozzles for distributing the metered fuel to each of said fuel injection nozzles for a period of time extending from the time before an associated intake valve is closed to the time after the same intake valve is closed, said fuel being injected intermittently from each of said fuel injection nozzles into an associated intake port both before and after the associated intake valve is closed;

an advancer connected to said distributor and operative in response to an increase in the rotational speed of said engine to advance the fuel distribution time of said distributor means; and fuel distribution time varying means connected to said distributor means and responsive to variations in the load on said engine to vary the ratio of the quantity of fuel injected by each injection nozzle into an associated intake port during the intake stroke of the associated cylinder to the amount of fuel injected by the same injection nozzle into said associated intake port during the succeeding compression stroke of the cylinder.

6. A fuel injection system for an internal combustion engine having a plurality of cylinders, an intake pipe, a throttle valve disposed in said intake pipe, intake ports interconnecting said intake pipe and said cylinders, and intake valves disposed in said intake ports, said system comprising:

fuel metering means mounted on said intake pipe and operative in response to the operating conditions of said engine to meter the flow of fuel supplied to said engine;

a plurality of fuel injection nozzles each disposed in one of said intake ports for injecting the metered fuel into said intake port;

a fuel distributor means connected to said fuel metering means and said nozzles for distributing the metered fuel to said fuel injection nozzles, said fuel being injected from each of said nozzles into an associated intake port for a period of time extending from the time before an associated intake valve is closed to the time after the same intake valve is closed, said fuel distributor means including a control cylinder having formed in the periphery thereof a plurality of fuel passages equal in number to the number of engine cylinders;

a shaft rotatably extending through said control cylinder and being rotatable in timed relationship with the rotation of said engine, said shaft having an axial fuel passage therein connected to said metering means, said shaft being further formed with at least one fuel distribution slit adapted to be successively brought into communication with respective fuel passages in said control cylinder by the rotation of said shaft relative to said cylinder; and a fuel distribution timing control means operatively connected to said advancer for rotating said control cylinder;

an advancer connected to said distributor means and operative in response to the increase in the rotational speed of said engine to advance the fuel distribution timing of said distributor, said advancer including weights mounted on said fuel distributor shaft so that said weights are rotated with said shaft and are expanded radially outwardly of said shaft by centrifugal force; and a cam member operatively associated with said weights so that said cam member is moved relative to said distribution time controlling means when said weights are expanded, said cam member having a cam surface operatively associated with said fuel distributin timing controlling means; and fuel distribution time varying means connected to said distributor and responsive to the variation in the load on said engine for varying the fuel distribution timing of said distributor, said fuel distribution time varying means including a link mechanism inerconnecting said throttle valve and said cam member so that the opening and closing movement of said throttle valve moves said cam member relative to said cam follower means to rotate said control cylinder.

7. A fuel injection system for an internal combustion engine having a plurality of cylinders, an intake pipe, intake ports interconnecting said intake pipe and said cylinders, and intake valves disposed in said intake ports, said system comprising:

fuel metering means mounted on said intake pipe and operative in response to the operating conditions of said engine to meter the flow of fuel supplied to said engine;

a plurality of fuel injection nozzles each disposed in one of said intake ports for injecting the metered fuel into said intake port;

a fuel distributor means connected to said fuel metering means and said nozzles for distributing the metered fuel to each of said fuel injection nozzles for a period of time extending from the time before an associated intake valve is closed to the time after the same intake valve is closed, said fuel being injected from each of said fuel injection nozzles into an associated intake port before and after the associated intake valve is closed;

a fuel distribution time varying means connected to said distributor means and responsive to variations in the load on said engine for varying the fuel distribution timing of said distributor means, said fuel distribution time varying means being operative to vary the ratio of the quantity of fuel injected by each injection nozzle into an associated intake port during the intake stroke of the associated cylinder to the amount of fuel injected by the same injection nozzle into said associated intake port during the succeeding compression stroke of the cylinder, said ratio being approximately 4 : 6 for a small load operating condition of said engine and being approximately 7 : 3 for intermediate and heavy load operating conditions of said engine; and an advancer connected to said distributor and operative in response to an increase in the rotational speed of said engine to advance the fuel distribution timing of said distributor.

* * * * *